US006968796B1

(12) United States Patent
Burke

(10) Patent No.: US 6,968,796 B1
(45) Date of Patent: Nov. 29, 2005

(54) MOORING CLEAT WITH ILLUMINATION

(75) Inventor: David W. Burke, 2640 N. Euclid, Bay City, MI (US) 48706

(73) Assignee: David W. Burke, Kawkawlin, MI (US)

( * ) Notice: Subject to any disclaimer, the term of this patent is extended or adjusted under 35 U.S.C. 154(b) by 0 days.

(21) Appl. No.: 10/926,622

(22) Filed: Aug. 26, 2004

Related U.S. Application Data

(60) Provisional application No. 60/499,121, filed on Nov. 18, 2003.

(51) Int. Cl.[7] ..... B63B 21/04
(52) U.S. Cl. ..... 114/218
(58) Field of Search ..... 114/218

(56) References Cited

U.S. PATENT DOCUMENTS 1,668,544 A * 5/1928 Armstrong et al. ..... 114/218
1,852,260 A * 4/1932 Perkins ..... 114/218
4,081,165 A * 3/1978 Fentress ..... 248/205.1
4,845,597 A * 7/1989 McCaghren ..... 362/477
5,216,972 A * 6/1993 Dufrene et al. ..... 362/477
5,438,944 A 8/1995 Burke
6,009,824 A * 1/2000 Ross ..... 114/218

* cited by examiner

*Primary Examiner*—Sherman Basinger
(74) *Attorney, Agent, or Firm*—Reising, Ethington, Barnes, Kisselle & Learman, P.C.

(57) ABSTRACT

Mooring cleats are mounted on the decks of watercraft and piers adjacent to the water for tying watercraft to piers and to other watercraft. Illumination is provided by forming an elongated groove in the top of the cleat bar center portion or in the cleat housing of a cleat that is pivotally attached to the cleat housing. An illumination member is mounted in the groove. The illumination member can include a tube of trinium gas or a plurality of light emitting diodes. Both light sources provide a visable line that can be seen during periods of reduced visibility. The viable line indicates the location of water and the direction of a safe movement.

17 Claims, 3 Drawing Sheets

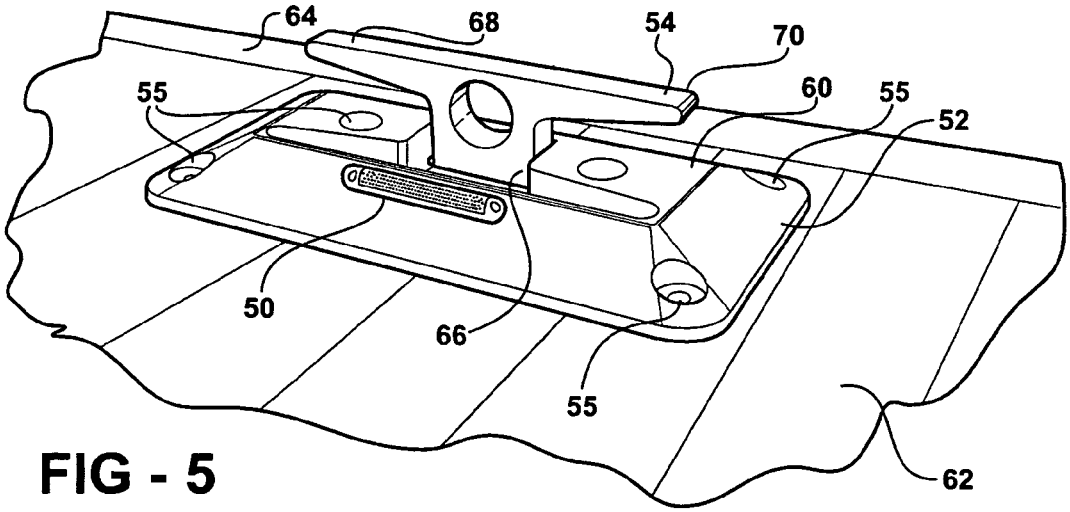
FIG - 5
FIG - 6
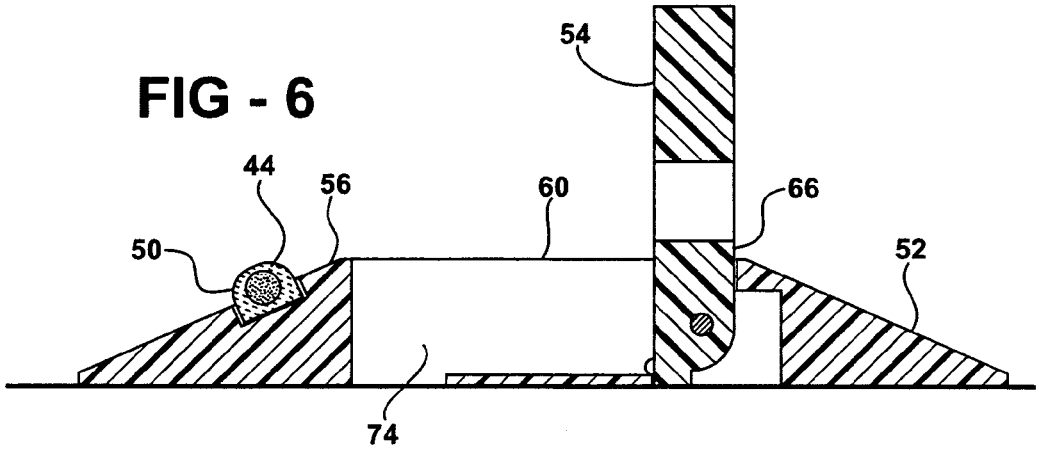
FIG - 7
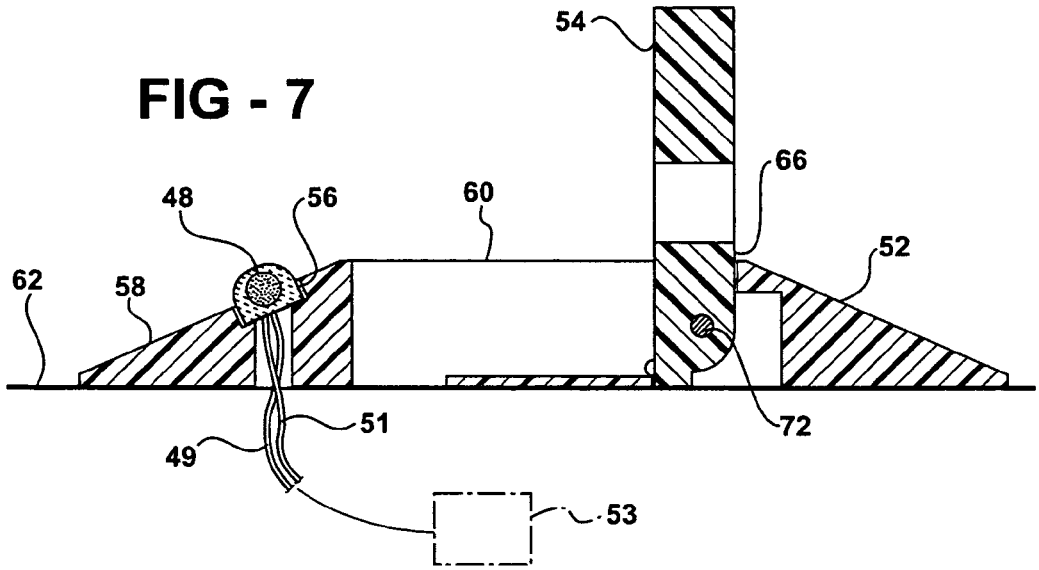

MOORING CLEAT WITH ILLUMINATION

This application claims the benefit of the filing date of the U.S. Provisional Application No. 60/499,121, titled "Mooring Cleat With Illumination," filed Nov. 18, 2003.

TECHNICAL FIELD OF THE INVENTION

The mooring cleat for mooring watercraft is attachable to a pier or a watercraft and is illuminated to indicate cleat location during periods of low visability.

BACKGROUND OF THE INVENTION

Piers are potentially dangerous places. Containers, equipment, cargo, ropes, chains and other items are deposited on piers. Some of these items are transferred from watercraft. Other items are awaiting transfer to watercraft. The remainder of items on a pier include equipment for transferring materials to and from watercraft and items for servicing watercraft. Most of these items are moved frequently and are only in one location on a pier temporarily. The edge or edges of a pier are often free of obstructions that could hinder access to or from a watercraft or that could prevent people from falling into the water.

A deck of a watercraft may be small, and is often a temporary storage area for ropes, nets, chains and other items relating to the operation or use of a watercraft. Railings and cables to keep people from falling from the deck of a watercraft are frequently minimal or non-existent.

Mooring cleats are attached to the edges of both piers and decks to receive lines and secure watercraft to piers. Because these cleats are on the edge of both piers and watercraft adjacent to the water, they indicate a location relative to the water and potential danger. During daylight hours and periods of good visibility, mooring cleats are easy to see and clearly indicate the location of a boundary that should not be crossed unintentionally.

During periods of darkness and periods of poor visibility it is difficult or even impossible to see mooring cleats. When the cleats cannot be seen, a person could trip on them and fall. A person could also walk off the edge of a pier or the side of a watercraft if a restraining system is not provided.

Piers and watercraft decks are not always well illuminated at night. Bright lights can make it difficult for the helmsman of an approaching watercraft to see what is under or to the rear of a bright light. Illumination on some watercraft is limited. It can be difficult to maintain electrical systems in a marine environment. The helmsman also needs to eliminate any artificial illumination that might interfere with his vision and ability to see other watercraft, piers, and other possible obstructions.

SUMMARY OF THE INVENTION

The mooring cleat assembly includes a center cleat section with a center top, a center bottom, a center left end and a center right end. A cleat left arm is integral with the center left end and extends outward from the center cleat section. A cleat right arm is integral with the center right end and extends outward from the center cleat section. At least one column is integral with the center bottom of the center cleat section and extends downward from the center cleat section. An elongated groove is formed in the center top of the center cleat section. An illumination source is mounted in the elongated groove. The illumination source can be tritium gas or a plurality of light emitting diodes. The diodes require a power source. The tritium gas does not require an outside power source. Both light sources are preferably low intensity light sources.

A mooring cleat assembly with a mooring cleat housing can also be illuminated. The mooring cleat housing has an upper housing surface, a housing first side, a housing second side, a housing first end, a housing second end, a housing bottom surface adapted to be supported by a deck, and a cleat recess. The cleat recess extends into the mooring cleat housing from the upper housing surface toward the housing bottom surface. A cleat includes a central post with a post upper end and a post free end, a first cantilevered arm integral with the post upper end and extending outward from a post first side, and a second cantilevered arm integral with the post upper end and extending outward from a post second side. A hinge pivot pivotally attaches the post free end to the mooring cleat housing for pivotal movement between a use position and a stowed position in the cleat recess. An elongated groove is provided in the mooring cleat housing. An illumination source is mounted in the elongated groove. The illumination source can be tritium gas or a plurality of light emitting diodes. The illuminated line provided by the light sources provides a warning of potential danger and indicates the directions in which it is safe to move.

Low intensity illumination is preferred. High intensity illumination could degrade night vision and may interfere with requirements for watercraft lighting.

BRIEF DESCRIPTION OF THE DRAWINGS

These and other objects, features and advantages will become more readily apparent in view of the following detailed description and best mode, appended claims and accompanying drawings, in which:

FIG. 5 is a perspective view of a surface-mounted collapsible mooring cleat housing and mooring cleat with illumination;

FIG. 6 is a vertical transverse sectional view of a surface mounted collapsible mooring cleat with a radioactive gas illumination source; and FIG. 7 is a vertical transverse sectional view of a surface mounted collapsible mooring cleat with an electrical illumination source.

DETAILED DESCRIPTION OF THE PREFERRED EMBODIMENTS

Figure 1:
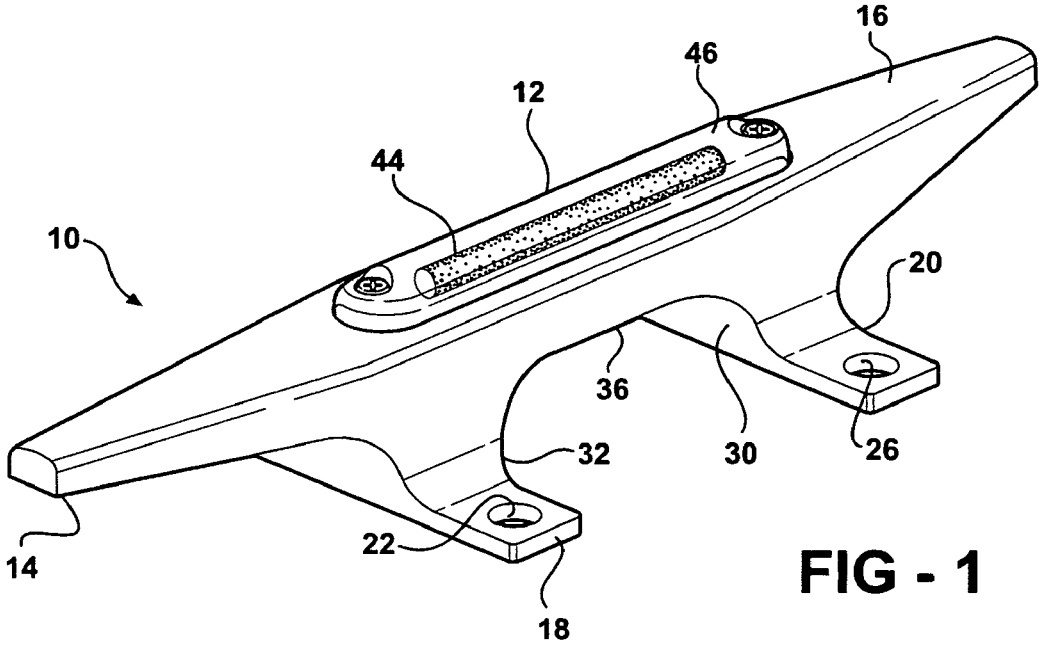
FIG. 1 a perspective view of the top of a cleat with illumination.

The mooring cleat 10 as shown in FIGS. 1–4 is a cleat of the type that is attached to the deck of a boat or other watercraft with illumination added. The cleat 10 has a center section 12, a left arm 14 and a right arm 16. The center section 12 has a first mooring plate 18 and a second mooring plate 20. These mooring plates 18 and 20 are integral with the ends of center section 12. The first mounting plate 18 has mulitple screw bores 22 for screws that clamps the first mounting plate to the deck of a watercraft. The second mounting plate 20 has multiple screw bores 26 for clamping the second mounting plate to the deck of a watercraft.

Screws work well in wood. If the deck is some other material, it may be desirable to use bolts or some other mechanical fastener in place of screws. The bores 22, and 26, as shown, have beveled sides. The fasteners that are used preferably have heads with a conical surface. The beveled sides permit the heads of the fasteners to be recessed into the first and second mounting plates 18 and 20. Recessing the fastener heads keeps the area around the cleat free of projections with sharp surfaces that could severe or abrade ropes and other lines used to moor a watercraft.

Figure 4:
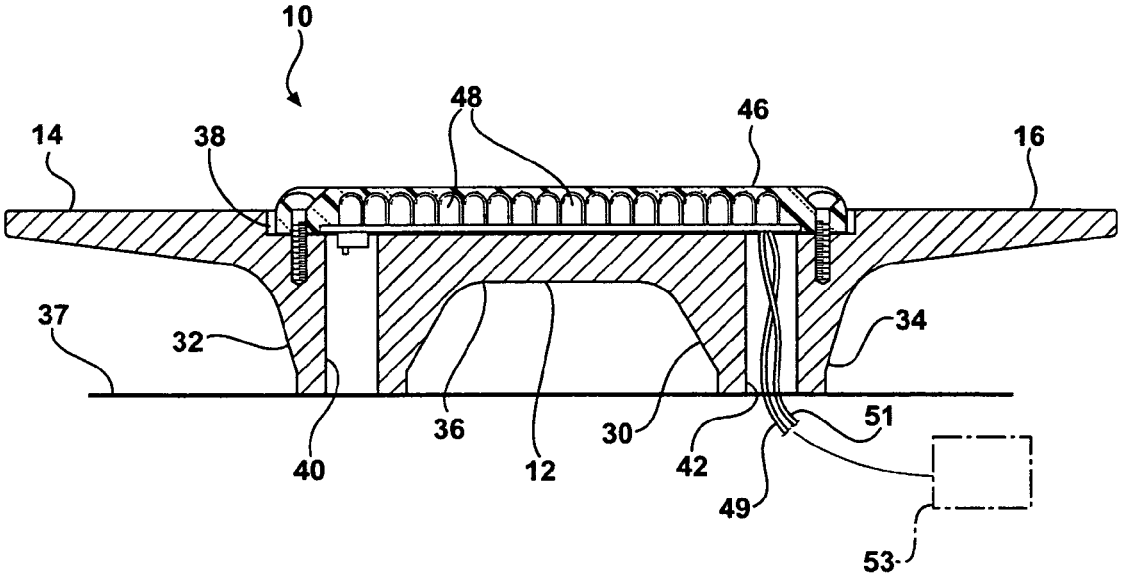
FIG. 4 is a vertical sectional view of an illuminated cleat with an electrical illumination source.

The center section 12 of the mooring cleat 10 has a recess 30 between the mounting plates 18 and 20 as shown in FIG. 4. The recess 30 permits water to pass between the mooring plates to ensure that the cleat 10 does not hold water. The recess 30 is formed by a first column 32 and a second column 34. The first column 32 is integral with one end of the center section 12 and the first mounting plate 18. The second column 34 is integral with the other end of the center section and the second mounting plate 20. Together, the first and second columns 32 and 34 and the center section 12 form an arch 36. The arch 36 holds the cantilevered left arm 14 and the cantilevered right arm 16 above the watercraft surface 37 to which the cleat 10 is secured thereby providing space for a line. The outer surfaces of the cleat 10 are all smooth and arcuate to eliminate sharp surfaces that could damage a line. The mounting plate 18 extends outward from both sides of the first column 32. The mounting plate 20 extends outward from both sides of the second column 34.

Figure 2:
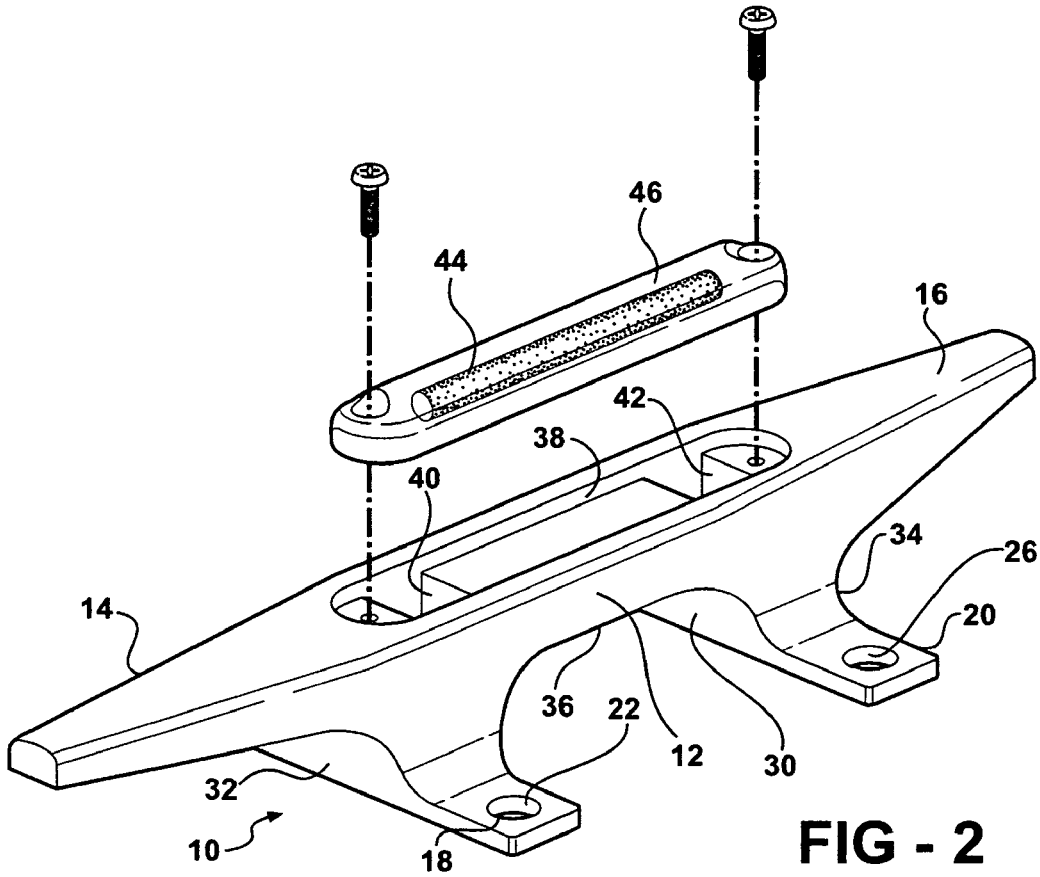
FIG. 2 is an perspective view of the top of an illuminated cleat, with the illumination source removed.
Figure 3:
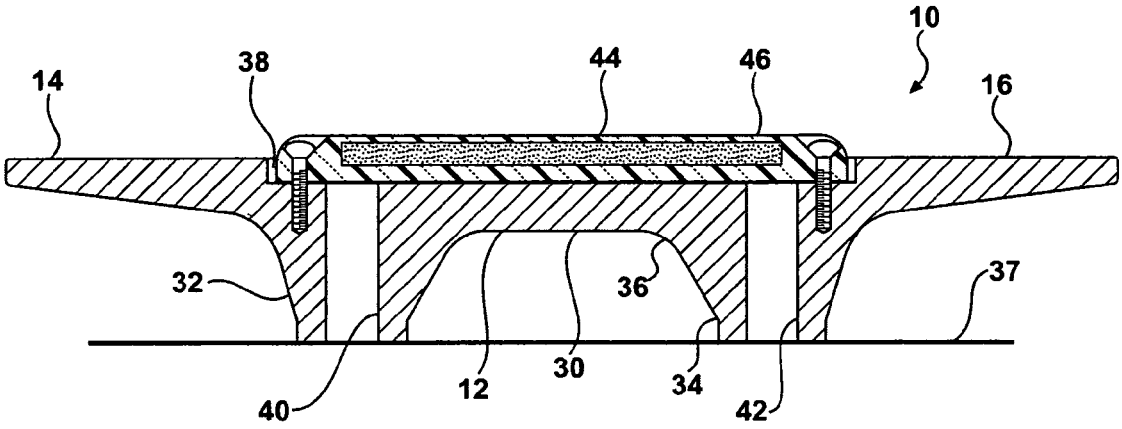
FIG. 3 is a vertical sectional view of the illuminated cleat with a radioactive gas illumination source.

A groove 38 is machined into the top of the center section 12 of the cleat 10. The groove 38, as shown in FIG. 2, intersects the vertical passage 40 through the first mounting plate 18 and the first column 32. The groove 38 also intersects the vertical passage 42 through the second mounting plate 20 and the second column 34.

A tube 44 of tritium gas is embedded in a molded transparent or translucent plastic 46. Tritium gas is a radioactive gas that glows in the dark and when there is reduced visibility. The glow can be in various colors. The glow will continue for about ten (10) years or more. Tritium gas is used in exit signs in commercial buildings and in other uses where safety is involved.

The tritium gas can be replaced by a glow rod. A glow rod is a plastic material that glows when light is received from an external source. Glow rods are made from a material similar to the material used to make fiber optic cables. The rod would replace the tube 44. Light can be transmitted to the glow rod from a diode by a fiber optic cable. The fiber optic cable extends from the end of the tube 44, through one of the vertical passages 40 or 42, through the deck and to a diode below the deck. The passage, for a fiber optic member, through the deck can be sealed. One fiber optic cable can transmit light, from one or two light emitting diodes or other light emitters energized by an electrical current, to a number of cleats 10.

A light plurality of emitting diodes 48 or other light emitters can also be mounted in the plastic member 46 or in the groove 38 under a transparent cover. When a diode or other light emitter is mounted directly in the groove 38, a removable cover for the groove 38 is required to permit diode replacement. Electric wires 49 and 51 are required to extend into the groove 38. Electrical connectors are difficult to maintain in marine environments. Potting light emitting diodes and their electric terminals in a transparent or translucent material 46 protects the diodes and terminals from water and other environmental conditions. Electrical systems 53 are, however, provided on many watercraft.

FIG. 5 shows a surface-mounted collapsible mooring cleat housing 52 that is modified to include an illuminated insert 50. The housing 52 is designed to be used on piers. The cleat 54 mounted in the housing 52 folds down into the housing as shown in U.S. Pat. No. 5,438,944 to Burke. When the cleat 54 is folded down there is little chance of a person tripping and falling on the cleat or the cleat housing 52. Forklift trucks and other wheeled vehicles can move over the low-profile housing without difficulty.

The illuminated insert 50 is mounted in a groove 56 formed in the cleat housing 52. The groove 56 is preferably in a surface 58 that is lower than the top surface 60 of the cleat housing 52.

The insert 50, as shown in FIG. 6, extends out of the groove 56 and is below the top surface 60 of the housing 52 to protect the insert and to position the insert where it can be seen by people on the pier 62. As shown in FIG. 5, the illuminated insert 50 is also on the opposite side of the housing 52 from the water edge 64 of the pier 62. The illuminated insert 50 can be illuminated by a radioactive material such as tritium gas in a tube 44 or by a glow rod. A glow rod of fiber optic material can provide illumination as described above. Light emitting diodes 48 can also be employed as the illumination source, if desired, as described above.

The cleat 54 includes a central post 66, a left cantilevered arm 68 and a right cantilevered arm 70. Both arms 68 and 70 are integral with the central post 66. The lower end of the central post 66 is pivotally attached to the cleat housing 52 by a horizontal pivot pin 72. The pivot pin 72 permits the cleat 54 pivot, from a vertical use position shown in FIG. 6, ninety degrees to a horizontal stowed position in a recess 74. When in the horizontal position, the cleat does not extend above the surface 60.

The cleat housing 52 is clamped to the edge of a pier by screws or bolts that pass through bores 55. The deck of a pier is generally wood planks. Wood planks can accommodate bolts and screws. If the pier has a concrete top, mechanical fasteners are available to clamp the housing 52 in place. The tritium gas works well for illuminating the insert 50. Diodes and other illumination devices can be used as described above, if a power source is available. It can be difficult, however, to add wiring or fiber optics to an existing pier.

Cleats 10 are generally attached to the deck of a watercraft adjacent to an edge on either side, the stern or the bow. Cleats 52 on a pier are generally clamped in place adjacent to an edge of the pier in the area where ships dock. The illumination of these cleats 10 and 52 help a person locate the cleats during periods of reduced illumination. Illuminated cleats also indicate where the edge of a watercraft or pier is located during periods of darkness thereby warning a person that there is a danger of falling into the water.

The disclosed embodiment is representative of a presently preferred form of the invention, but is intended to be illustrative rather than definitive thereof. The invention is defined in the claims.

What is claimed is:

1. A mooring cleat comprising:

a center cleat section with a center top, a center bottom, a center left end and a center right end;

a cleat left arm integral with the center left end and extending outwardly from the center cleat section;

a cleat right arm integral with the center right end and extending outwardly from the center cleat section;

at least one column integral with the center bottom of the center cleat section and extending downward from the center cleat section;

an elongated horizontal groove formed in the center top of the center cleat section; and an illumination source mounted in the elongated horizontal groove.

2. A mooring cleat, as set forth in claim 1, including a mooring plate integral with a column free end of the at least one column and adapted to be secured to a vessel.

3. A mooring cleat, as set forth in claim 1, wherein the at least one column includes a left column integral with the center bottom of the center cleat section and spaced from the center right end, a right column integral with the center bottom of the center cleat section, spaced from the center left end and spaced from the left column;

a left mooring plate integral with a left column free end and adapted to the secured to a surface; and a right mooring plate integral with the right column free end and adapted to be secured to the surface.

4. A mooring cleat, as set forth in claim 1, wherein the illumination source mounted in the elongated horizontal groove includes a tube filled with tritium gas.

5. A mooring cleat, as set forth in claim 4, wherein the tube filled with tritium gas is mounted in a translucent plastic.

6. A mooring cleat, as set forth in claim 1, wherein the illumination source mounted in the elongated groove includes a plurality of light emitting diodes mounted in a plastic material.

7. A mooring cleat, as set forth in claim 6, wherein the plurality of light emitting diodes are connected to an electric system by an electric wire that extends through a passage through the at lease one column and that intersects the elongated horizontal groove.

8. A mooring cleat comprising:

a mooring cleat housing having an upper housing surface, a housing first side, a housing second side, a housing first end, a housing second end, a housing bottom surface adapted to be supported by a deck, and a cleat recess extending into the mooring cleat housing from the upper housing surface toward the housing bottom surface;

a cleat including a central post with a post upper end and post free end, a first cantilevered arm integral with the post upper end and extending outward from a post first side, and a second cantilevered arm integral with the post upper end and extending outward from a post second side;

a hinge pivot pivotally attaching the post free end to the mooring cleat housing for a pivotal movement between a use position and a stowed position in the cleat recess;

an elongated groove in the mooring cleat housing; and an illumination source mounted in the elongated groove.

9. A mooring cleat, as set forth in claim 8, wherein the illumination source mounted in the elongated groove includes a tube filled with tritium gas.

10. A mooring cleat, as set forth in claim 9, wherein the tube filled with tritium gas is mounted in a translucent plastic.

11. A mooring cleat, as set forth in claim 8, wherein the illumination source in the elongated groove includes a plurality of light emitting diodes mounted in a plastic material.

12. A mooring cleat, as set forth in claim 11, wherein the plurality of light emitting diodes are connected to an electric system by electric wires that extend out of the mooring cleat housing.

13. A mooring cleat, as set forth in claim 8, wherein a portion of the upper housing surface of the mooring cleat housing is spaced above the housing bottom surface a greater distance than the illumination source to protect the illumination source.

14. A mooring cleat, as set forth in claim 1, wherein the elongated horizontal groove has a horizontal floor.

15. A mooring cleat, as set forth in claim 14, wherein the elongated horizontal groove has a first elongated side wall, and a second elongated side wall that is generally parallel to the first elongated side wall.

16. A mooring cleat, as set forth in claim 1, wherein the elongated horizontal groove extends from the cleat left arm to the cleat right arm.

17. A mooring cleat comprising:

a center cleat section with a center top, a center bottom, a center left end and a center right end;

a cleat left arm integral with the center left end and extending outwardly from the center cleat section;

a cleat right arm integral with the center right end and extending outwardly from the center cleat section;

at least one column integral with the center bottom of the center cleat section extending downward from the center cleat section;

an elongated horizontal groove formed in the center top of the center cleat section;

an illumination source including a plurality of light emitting diodes mounted in a plastic material and mounted in the elongated groove; and wherein the plurality of light emitting diodes are connected to an electric system by an electric wire that extends through a passage through the at least one column and that intersects the elongated groove.

* * * * *